US005948223A

United States Patent [19]

Horikoshi et al.

[11] Patent Number: 5,948,223

[45] Date of Patent: Sep. 7, 1999

[54] LOW HYDROGEN OVERVOLTAGE CATHODE AND PROCESS FOR THE PRODUCTION THEREOF

[75] Inventors: Hideharu Horikoshi; Kazumasa Suetsugu; Takashi Sakaki; Kanji Yoshimitsu, all of Yamaguchi, Japan

[73] Assignee: Tosoh Corporation, Yamaguchi, Japan

[21] Appl. No.: 08/733,420

[22] Filed: Oct. 18, 1996

[30] Foreign Application Priority Data

| | | | |
|---|---|---|---|
| Oct. 18, 1995 | [JP] | Japan | 7-269761 |
| Nov. 16, 1995 | [JP] | Japan | 7-298694 |
| Jun. 27, 1996 | [JP] | Japan | 8-167701 |

[51] Int. Cl.[6] ..... C25B 11/00

[52] U.S. Cl. ..... 204/290 R; 204/293; 429/59; 429/101; 420/900

[58] Field of Search ..... 204/290 R, 293; 429/59, 101; 420/900

[56] References Cited

U.S. PATENT DOCUMENTS

| | | | |
|---|---|---|---|
| 4,080,278 | 3/1978 | Ravier et al. | 204/242 |
| 4,152,240 | 5/1979 | Kuo | 204/290 R |
| 4,162,204 | 7/1979 | Kuo | 204/43 R |
| 4,248,679 | 2/1981 | Welch et al. | 204/98 |
| 4,251,478 | 2/1981 | Welch et al. | 204/98 |
| 4,342,792 | 8/1982 | Brown et al. | 427/34 |
| 4,357,227 | 11/1982 | Gray | 204/290 R |
| 4,370,361 | 1/1983 | Gray | 427/123 |
| 4,374,712 | 2/1983 | Gray | 204/98 |
| 4,394,228 | 7/1983 | Gary | 204/98 |
| 4,402,815 | 9/1983 | Brown et al. | 204/290 R |
| 4,410,413 | 10/1983 | Hall | 204/290 R |
| 4,425,203 | 1/1984 | Gray | 204/129 |
| 4,465,580 | 8/1984 | Kasuya | 204/290 R |
| 4,496,442 | 1/1985 | Okazaki et al. | 204/129 |
| 4,746,584 | 5/1988 | Tenhover et al. | 428/670 |
| 5,112,388 | 5/1992 | Schulz et al. | 75/255 |

FOREIGN PATENT DOCUMENTS

| | | |
|---|---|---|
| 0009406 | 4/1980 | European Pat. Off. . |
| 0099867 | 2/1984 | European Pat. Off. . |

*Primary Examiner*—Bruce F. Bell
*Attorney, Agent, or Firm*—Sughrue, Mion, Zinn, Macpeak & Seas, PLLC

[57] ABSTRACT

A cathode of sufficiently low hydrogen overvoltage is provided which is useful in electrolysis of water or of an aqueous alkali metal chloride solution such as a sodium chloride solution. A process for producing the cathode is also provided. The low hydrogen overvoltage cathode has an electroconductive base material coated with an alloy layer containing nickel and molybdenum, the alloy layer containing the nickel at a content ranging from 35 to 90% by weight and the molybdenum at a content ranging from 10 to 65% by weight. The alloy laser has an X-ray diffraction (CuKα line) pattern with a main peak at an angle ranging from 42 to 45° with a peak half width ranging from 0.4 to 7°. One process for producing the low hydrogen overvoltage cathode of the present invention involves plating an electroconductive base material by an arc discharge type ion plating method. Another process for producing the low hydrogen overvoltage cathode of the present invention involves co-electrodepositing nickel and molybdenum onto an electroconductive base material in a plating bath.

9 Claims, 2 Drawing Sheets

LOW HYDROGEN OVERVOLTAGE CATHODE AND PROCESS FOR THE PRODUCTION THEREOF

BACKGROUND OF THE INVENTION

1. Field of the Invention

The present invention relates to a low hydrogen overvoltage cathode for the electrolysis of water or an aqueous alkali metal chloride such as aqueous sodium chloride, and also to a process for producing the low hydrogen overvoltage cathode.

2. Description of the Related Art

Industrial electrolysis of water or an aqueous alkali metal chloride consumes a large amount of electric power, so that various energy saving techniques are being developed for industrial electrolysis procedures. "Energy saving techniques" means techniques which result in a substantial decrease of the electrolysis voltage which techniques can include decreasing the theoretical electrolysis voltage, solution resistance, diaphragm resistance, cathode overvoltage and anode overvoltage. In particular, the mentioned overvoltages, which largely depend on the electrode material and the electrode surface state, have attracted the attention of many research scientists, and many developments have been made in this area.

For instance, in the ion exchange process for sodium chloride electrolysis, a decrease of the anode overvoltage has been actively studied. Consequently, anodes have been developed which do not involve problems regarding anode overvoltage; such anodes are in wide use industrially.

Many proposals have also been made regarding low hydrogen overvoltage cathodes, namely active cathodes which can have their hydrogen overvoltage lowered by 200–250 mV in comparison with a conventional iron cathode exhibiting a hydrogen overvoltage of 400 mV. For example, a hydrogen absorbing alloy or a platinum group metal oxide has been deposited on an electrode base material surface (Japanese Patent Laid-Open Publications 59-25940 and 6-146046). Further, a coating layer of an alloy of a transition metal such as iron, cobalt and nickel, tungsten or molybdenum has been formed by plating the same on an electrode base material surface (Japanese Patent Publication 40-9130). However, the electrodes having a hydrogen absorbing alloy or a platinum group metal oxide deposited thereon use an expensive material, which results in high cost, whereas while the latter electrodes covered with an alloy of a transition metal, etc., can be produced at low cost, they are not sufficient in reducing the hydrogen overvoltage. Thus, both types of electrodes still involve problems.

To improve electrodes plated with an alloy of iron, cobalt, nickel or molybdenum, a water-soluble polyamine has been added to the alloy plating bath (Japanese Patent Laid-Open Publication 55-65376). However, this involves disadvantages in that the polyamine is soluble only over a narrow pH range which makes control of the plating bath difficult on an industrial scale. Further, the decrease of the hydrogen overvoltage is still insufficient.

Most of the active cathodes to date comprise an electrode base material and a catalyst layer of a specific composition formed thereon to decrease the hydrogen overvoltage. The coating layer is formed in various ways. For example, a catalytic substance can be electrically deposited by wet plating from a bath containing a dispersed active substance or containing a dissolved metal salt as disclosed in the aforementioned patents; a catalytic metal substance in a molten state can be directly sprayed onto a base material (Japanese Patent Laid-Open Publication 61-41786); a metal salt solution can be applied onto a base material, dried, and subjected to reduction or other treatment to form a catalytic substance layer (Japanese Patent Laid-Open Publication 61-295386); etc. However, in the wet plating method the alloy composition for coating is limited due to differences in electrodeposition potentials which is a disadvantage. Further, the composition of the active substances or the metal components in the plating bath tend to change over the time of plating, requiring strict control of the bath to obtain a homogeneous alloy layer in a stable manner. On the other hand, in the last two methods, alloy formation is difficult with elements having a large difference in vapor pressure because of the high temperature treatment required for coating, and an amorphous or fine crystalline structure of high performance cannot readily be obtained because of enhanced crystallization in the high temperature treatment, which is disadvantageous. To avoid crystallization, a sputtering method has been proposed (Japanese Patent Laid-Open Publication 7-268676). However, the sputtering method still has the problem that the film formation rate is low.

SUMMARY OF THE INVENTION

The inventors herein made comprehensive studies to solve the above problems involved in low hydrogen overvoltage cathodes. Consequently, it was found that a low hydrogen overvoltage can be attained using a cathode produced by an arc discharge type ion plating technique in which target atoms are vaporized and ionized, and the resultant catalytic substance is deposited to coat a base material.

It has also been found that a cathode covered with a composition and structure having a low hydrogen overvoltage performance can be produced by a wet plating technique by controlling the composition and the pH of the plating bath without complicating a conventional plating system by bath additives.

An object of the present invention is to provide a low hydrogen overvoltage cathode for electrolysis of water or an alkali metal chloride such as sodium chloride.

Another object of the present invention is to provide a process for producing the above cathode.

The low hydrogen overvoltage cathode of the present invention comprises an electroconductive base material coated with an alloy layer containing nickel and molybdenum, the alloy layer containing nickel at a content ranging from 35 to 90% by weight and molybdenum at a content ranging from 10 to 65% by weight, and showing, upon X-ray diffraction with a CuKα line, a main peak at an angle ranging from 42 to 45° with a peak half width ranging from 0.4 to 7°.

One process for producing the low hydrogen overvoltage cathode of the present invention comprises plating an electroconductive base material by an arc discharge type ion plating method with a target containing nickel at a content ranging from 35 to 90% by weight and molybdenum at a content ranging from 10 to 65% by weight at a potential on the electroconductive base material ranging from −100 to 50 V with the introduction of a gas containing at least one of hydrogen, carbon, nitrogen and oxygen as a reaction gas.

Another process for producing the low hydrogen overvoltage cathode of the present invention comprises co-electrodepositing at least nickel and molybdenum onto an electroconductive base material in a plating bath, the plating bath containing nickel ions, molybdate ions, and a complexing agent at an Mo/(Ni+Mo) ratio ranging from 5 to 20 mol % at a total concentration of nickel ions and molybdate ions ranging from 0.1 to 0.5 mol/l in the plating bath kept at a pH ranging from 7 to 9.

The alloy layer preferably contains at least one of the 4d transition metals, noble metals, and lanthanide elements in an amount of from 0.1 to 10% by weight in addition to nickel and molybdenum.

DETAILED DESCRIPTION OF THE PREFERRED EMBODIMENTS

Figure 1:
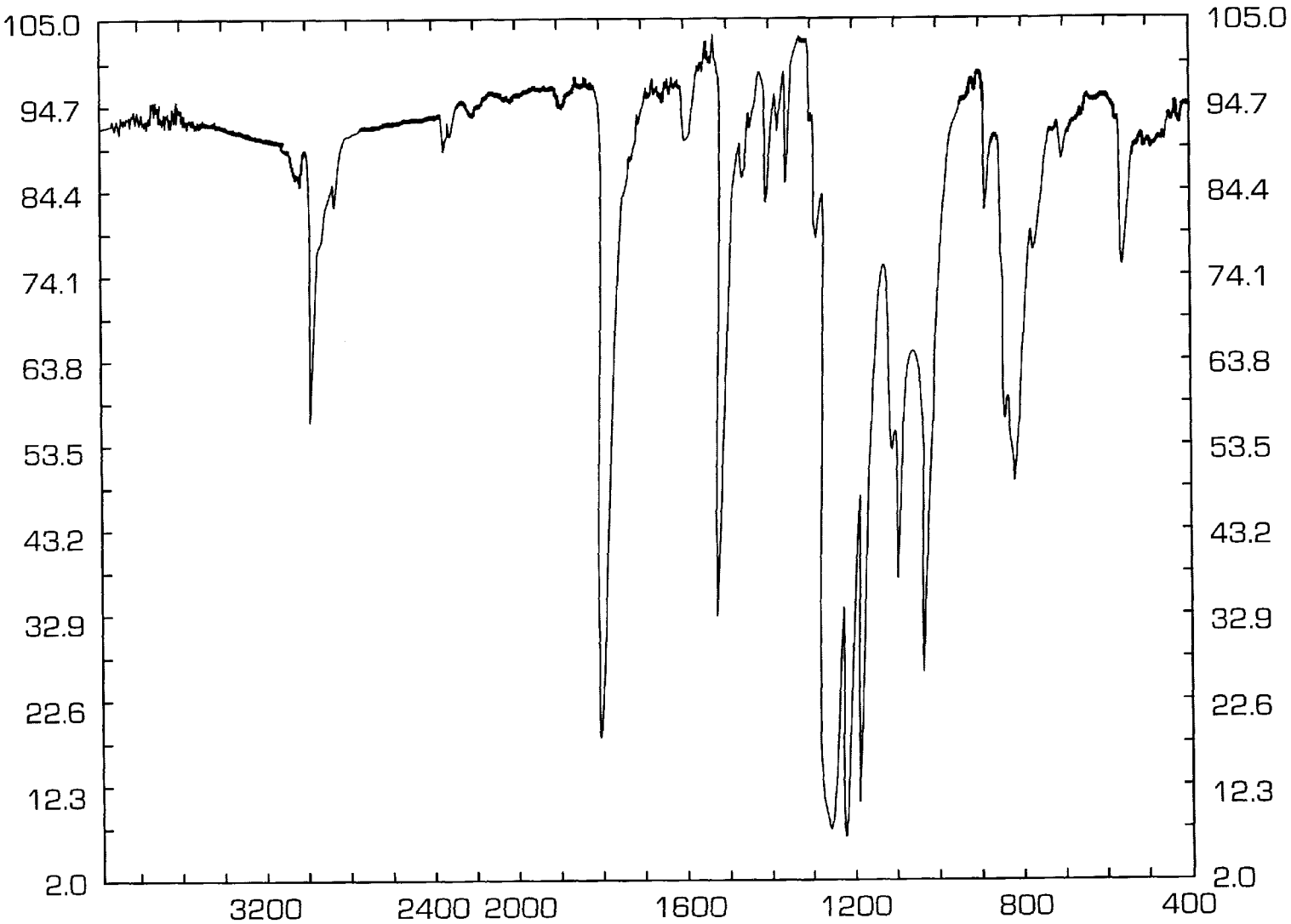
FIG. 1 shows the X-ray diffraction pattern of the alloy layer obtained in Example 3.

The electroconductive base material to be coated with the alloy layer in the present invention includes nickel, iron, copper, titanium, stainless steel and other metals which are resistant to caustic alkali. The shape of the electroconductive base material is not limited, and it may be in a shape suitable for the cathode of an electrolytic cell, for example, in a shape of a flat plate, a curved plate, an expandable metal, a punched metal, a net and a perforated panel.

The electroconductive base material is preferably subjected to a conventional pretreatment such as degreasing, vacuum heating and ion bombardment. For strengthening the adhesion between the base material and the alloy layer, is plating of the base material with a suitable nickel alloy or deposition of electroconductive fine particles of carbon, a platinum group metal or the like, onto the base material is effective to roughen the surface.

The alloy layer preferably has a thickness in the range of from 5 to 500 $\mu$m, since a thinner alloy layer is not effective enough for reducing the hydrogen overvoltage and a thicker alloy layer is liable to come off.

The processes for forming the alloy layer of the present invention are now explained specifically.

One process is arc discharge type ion plating (AIP) and another process is wet plating.

The AIP technique is first described. The target used for the AIP is prepared in the same manner as those in usual ion plating. The target elements are physically mixed by means of a ball mill or the like, and shaped by press molding by CIP (cold isostatic pressing), HIP (hot isostatic pressing) or a like method. The method for preparation of the target is not limited, provided that the target elements are mixed uniformly and finely. The elements are not necessarily required to be alloyed in the prepared target.

In the AIP technique, the composition of the coating alloy is nearly the same as the composition of the target, so that the coating composition can be controlled as desired by controlling the composition of the target. Nickel and molybdenum, which have vapor pressures which greatly differ, cannot readily be formed into a coating alloy layer by thermal spraying conducted at a high temperature. However, such elements which differ greatly in vapor pressure and which are not suitable for thermal spraying can readily be alloyed according to the process of the present invention by vaporizing the target atoms at a relatively low temperature by arc discharge.

The alloy layer thickness can be controlled readily by the time of layer formation. The nickel-molybdenum alloy layer is formed at a rate of several microns for 10 minutes. This rate of alloy layer formation can be raised by simultaneously using plural targets. Thus, a thick alloy layer can readily be formed in comparison with other ion plating techniques or sputtering techniques.

Using the AIP technique, the alloy layer having the composition of the present invention is obtained by controlling the target composition and the layer forming conditions. Specifically, a target is employed which contains nickel at a content of from 35 to 90% by weight and molybdenum at a content of from 10 to 65% by weight, and the layer formation is conducted by applying a potential of from −100 to 50 V to a base material. In the case where at least one of the 4d transition metals, noble metals, and lanthanide elements is to be incorporated into the alloy layer, a target is preferably used which contains the intended element other than nickel and molybdenum in an amount of from 0.1 to 10% by weight, in addition to nickel and molybdenum.

The layer formation is conducted with the introduction of a reaction gas containing at least one of hydrogen, carbon, nitrogen and oxygen. The hydrogen-containing gas is a gas containing hydrogen atoms as a gas component, including $H_2$ and $H_2O$. The carbon-containing gas includes $CH_4$ and $C_2H_8$. The nitrogen-containing gas includes $N_2$ and $NH_3$. The oxygen-containing gas includes $O_2$ and CO. The reaction gas is not limited to those mentioned. By arc discharge type ion plating under the aforementioned conditions, a low hydrogen overvoltage cathode can be produced which comprises an electroconductive base material coated with an alloy layer containing nickel and molybdenum at a nickel content of from 35 to 90% by weight and at a molybdenum content of from 10 to 65% by weight, and showing, upon X-ray diffraction with a CuK$\alpha$ line, a main peak at an angle ranging from 42 to 45° with a half width ranging from 0.4 to 7°.

The potential applied to the base material is more preferably in the range of from −60 to 30 V.

In the ion plating, the target atoms are ionized and deposited onto the base material to cover it. At a potential of the base material outside the potential range of the present invention, the kinetic energy of the coating ions is excessively large which causes a significant temperature rise of the base material by collision of the ions against the base material, making impracticable the formation of a coating layer of the crystal structure set forth in the claims. Further, at a larger absolute value of the potential of the base material, the layer composition deviates greatly from the target composition to make the formation of the intended composition of the alloy layer impractical.

The wet plating technique will now be explained. In the wet plating technique, the counter electrode for the plating is not especially limited, and soluble electrodes such as a nickel plated electrode and insoluble electrodes such as a platinum plated electrode and a titanium plate plated with platinum may be used as the counter electrode.

For producing the alloy layer of the composition and structure of the present invention, the plating bath composition for the wet plating is controlled to be within a specified concentration range. Specifically, the plating bath is controlled so as to contain nickel ions, molybdate ions, and a complexing agent at an Mo/(Ni+Mo) ratio ranging from 5 to 20 mol % at a total concentration of nickel ions and molybdate ions ranging from 0.1 to 0.5 mol/l. The sources of nickel and molybdenum are not especially limited. The nickel sources include nickel salts such as nickel sulfate, nickel chloride, and mixtures thereof. The molybdenum sources include sodium molybdate, potassium molybdate and ammonium molybdate. The complexing agent is not especially limited, and may be any complexing agent which can readily form a complex with nickel ions. The complexing agents include citric acid, tartaric acid and pyrophosphoric acid. The amount of the complexing agent is not especially limited, but the amount of the complexing agent is usually an amount of from 0.1 to 2 moles per mole of the total of the nickel ions and the molybdate ions in the plating bath.

The pH of the plating bath should be controlled to be within a specified range in order to produce the alloy layer of the composition and structure of the present invention. Specifically, the pH is controlled to be in the range of from 7 to 9. The chemicals for adjusting the pH are not limited, and include inorganic acids such as sulfuric acid and hydrochloric acid, and inorganic bases such as sodium hydroxide and aqueous ammonia.

The composition and structure of the alloy layer of the present invention also depend on the plating bath temperature and the plating current density. These are controlled by selecting conventional conditions as shown in the Examples in Japanese Patent Publication 40-9130, Japanese Patent Laid-Open Publication 55-65376, etc. The plating bath temperature is selected to be in the range of from 20 to 70° C. At a lower temperature the plating efficiency will be lower, and the process is uneconomical whereas at a higher temperature the resulting alloy coating layer becomes disadvantageously brittle. The plating current density is preferably in the range of from 2 to 20 A/dm$^2$. At a lower plating current density the molybdenum content of the alloy layer will be lower than the specified range of the present invention, which causes a high cathode overvoltage, whereas at a higher current density the plating efficiency is lower, and the process is uneconomical.

In wet plating, the intended performance of the alloy layer can be obtained by observing the above conditions, independently of using a third component which has been added to increase the surface layer present in the plating bath which is incorporated into the alloy layer.

The alloy layer coating the surface of the electroconductive base material in the present invention should comprise at least nickel and molybdenum and show a peak in its X-ray diffraction pattern with a half width ranging from 0.4 to 7°. To achieve such a half width, the temperature during and after the formation of the alloy layer is very important. If the alloy layer is treated at a temperature above 150° C., the crystallinity of the alloy becomes higher and the half width deviates from the above specified values. For example, a nickel-molybdenum cathode, which is produced by flame spraying, as described in Japanese Patent Laid-Open Publication 55-100988, is always treated at a high temperature, producing an alloy layer having a diffraction peak half width outside the specified value range of the present invention. Thus, heat treatment at a temperature higher than 150° C. during or after the alloy layer production prevents formation of a crystal structure having a peak of the specified half width of the present invention or destroys the crystal structure thereof, which results in an electrode giving a significantly high cathode overvoltage. Therefore, heat treatment after plating is undesirable. In particular, a heat treatment at 150° C. or a higher temperature sharpens the X-ray diffraction peak, and causes the formation of molybdenum single crystals or intermetallic compound crystals of nickel and molybdenum to change the crystal structure, leading to a remarkably high cathode overvoltage.

The composition of the alloy coating layer is preferably in the range of a nickel content of from 40 to 85% by weight and a molybdenum content of from 15 to 60% by weight, more preferably a nickel content of from 45 to 80% by weight and a molybdenum content of from 20 to 55% by weight, in accordance with the present invention. At a nickel content or molybdenum content outside the claimed range, the region of simple nickel or simple molybdenum becomes larger to prevent nickel-molybdenum alloy formation, resulting in a remarkable increase of the overvoltage. Even at a nickel and molybdenum content within the claimed range, an alloy having an X-ray diffraction peak outside the claimed peak position range or the claimed half width range is different in crystal structure from an alloy showing the desired low hydrogen overvoltage, and results in a high overvoltage.

The hydrogen overvoltage is further advantageously lowered by incorporating at least one of the 4d transition metals, noble metals and lanthanide elements in an amount of from 0.1 to 10% by weight into the nickel-molybdenum coating layer.

The present invention is described more specifically by reference to the following Examples without limiting the invention in any way.

EXAMPLES 1–7

The samples of Examples 1–7 were prepared by arc discharge type ion plating using a target composed of 60% by weight nickel and 40% by weight molybdenum (50 atom% Ni and 50 atom% Mo) and plating onto a nickel plate as a base material (40×50 mm$^2$) whose surface had been degreased and cleaned. The arc type ion plating was conducted using the ion plating apparatus SIA-400T (manufactured by Show Shinku K.K.) at a vacuum of $1\times10^{-3}$ Torr at an arc current of 100 A for 50 minutes to form a coating layer. An electrode was thus prepared which had an Ni-Mo alloy coating layer about 20–30 $\mu$m thick on the base material. The layer formation conditions are given in Table 1, and the properties of the coating layers are given in Table 2.

Figure 2:
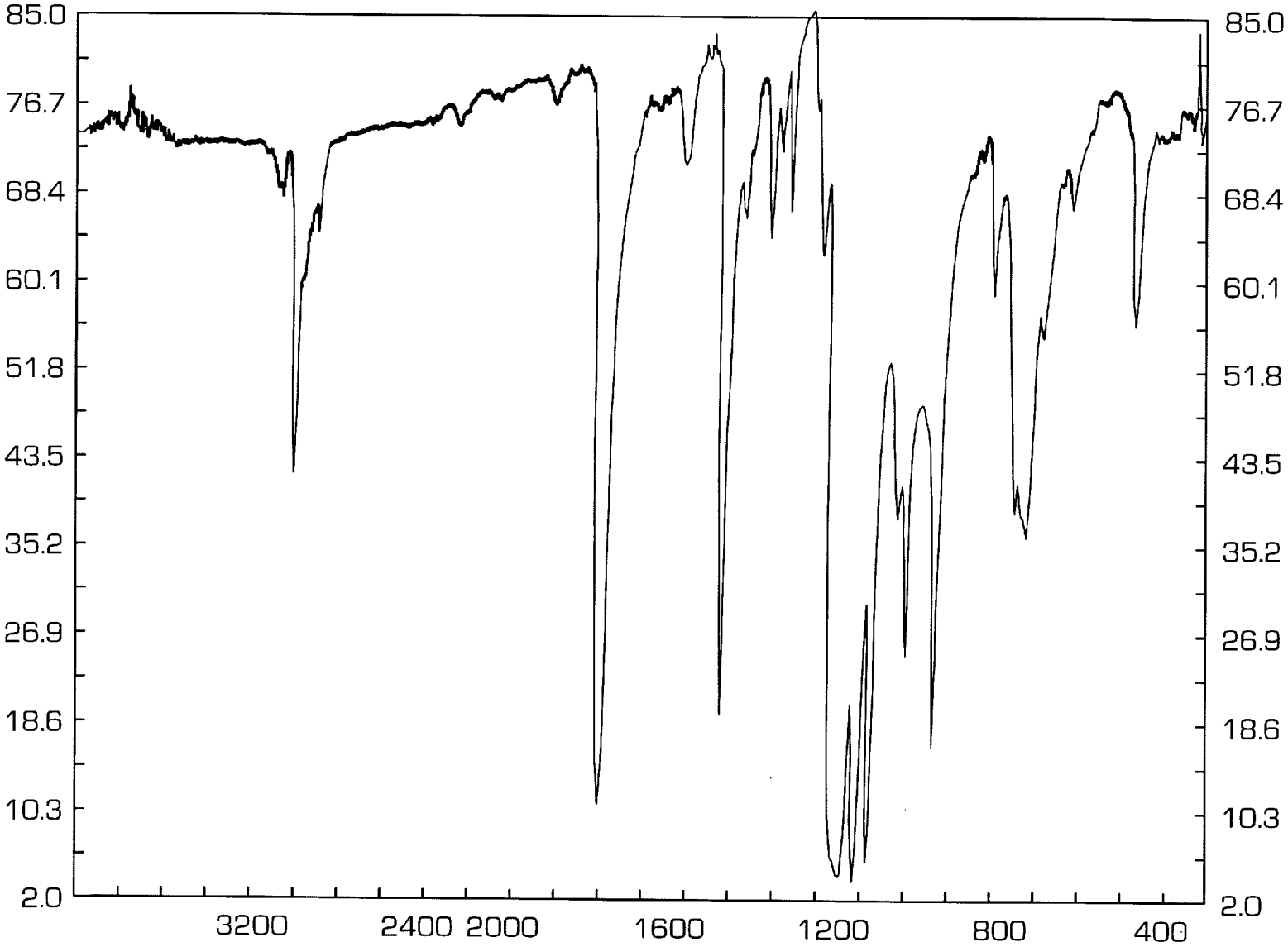
FIG. 2 shows the X-ray diffraction pattern of the alloy layer obtained in Example 6.
Figure 1:
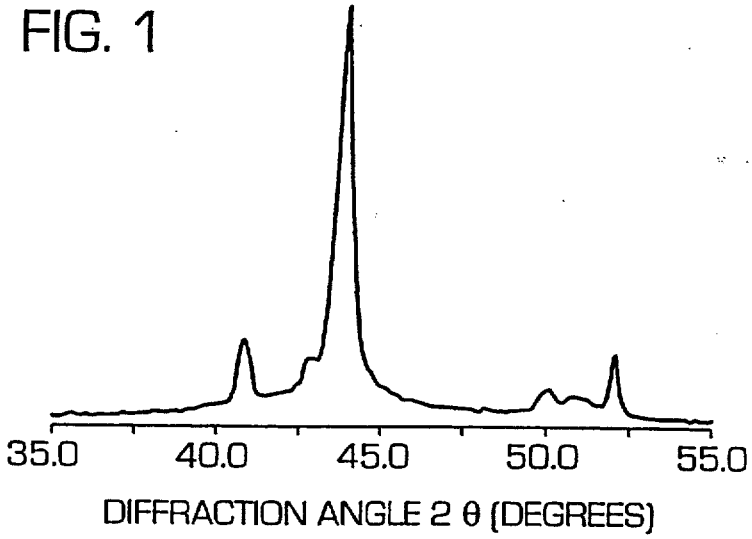
Figure 2:
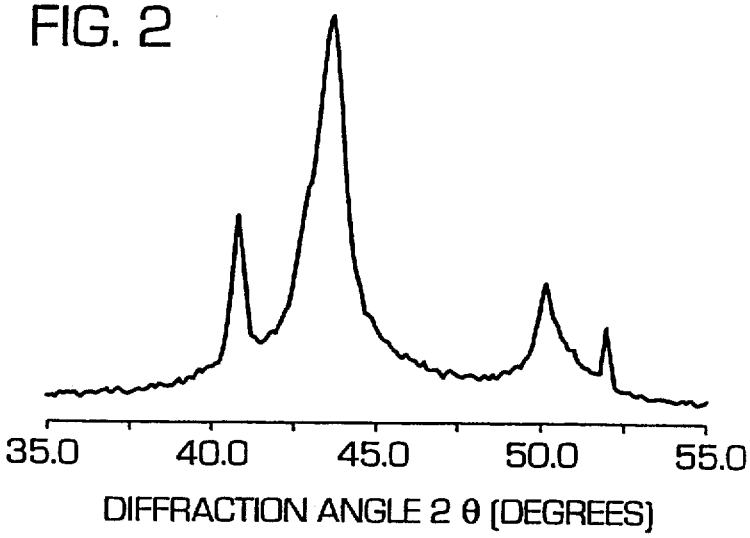

The alloy composition of the coating layer was determined using an X-ray microanalyzer, and is given by calculation on the basis of the Ni concentration+Mo concentration=100. The position of the main peak and the half width were derived from the CuKα X-ray diffraction pattern. The hydrogen overvoltage was measured by the current interrupter method at 90° C. in a 32.5% sodium hydroxide solution at a current density of 40 A/dm$^2$. FIG. 1 and FIG. 2 show, respectively, the X-ray diffraction pattern of the coating layers obtained in Example 3 and Example 6.

COMPARATIVE EXAMPLES 1–2

Coating layers were formed in the same manner as in Example 1 except that the potential of the base material was set at −300 V. The layer formation conditions and the layer properties are given, respectively, in Table 1 and Table 2.

Figure 3:
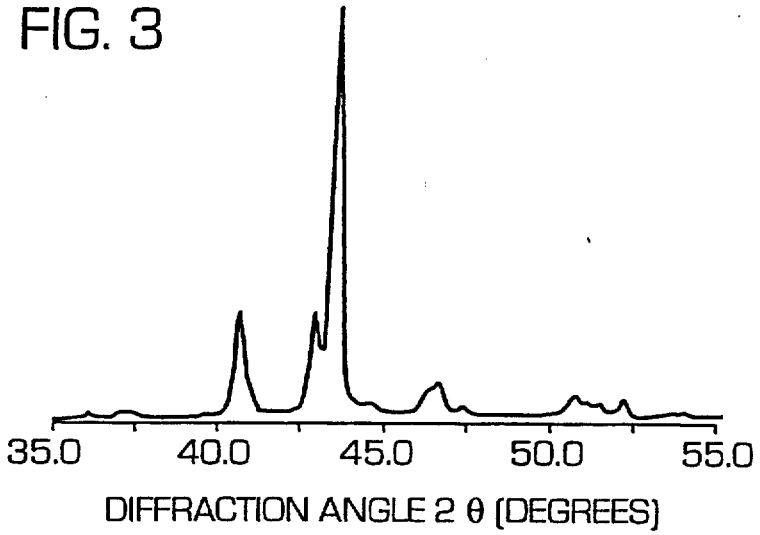
FIG. 3 shows the X-ray diffraction pattern of the alloy layer obtained in Comparative Example 2.

The resulting coating layers had a half width outside the claimed range, showing overvoltages of as high as about 280–320 mV. FIG. 3 shows the X-ray diffraction pattern of the coating layer obtained in Comparative Example 2.

EXAMPLES 8–10

The samples of Examples 8–10 were prepared by arc discharge type ion plating using a target composed of 60% by weight of nickel and 40% by weight of molybdenum or a target further containing 5% by weight of silver or lanthanum in addition to nickel and molybdenum. The layer formation conditions are given in Table 3, and the properties of the resulting coating layers are given in Table 4.

EXAMPLES 11–14

Coating films were formed using four kinds of targets having compositions of 10–65% by weight molybdenum, balance nickel, under a vacuum of $1\times10^{-3}$ Torr at an arc current of 100 A for 50 minutes under the conditions given in Table 5. The properties of the formed coating layers are given in Table 6.

COMPARATIVE EXAMPLES 3–4

Figure 4:
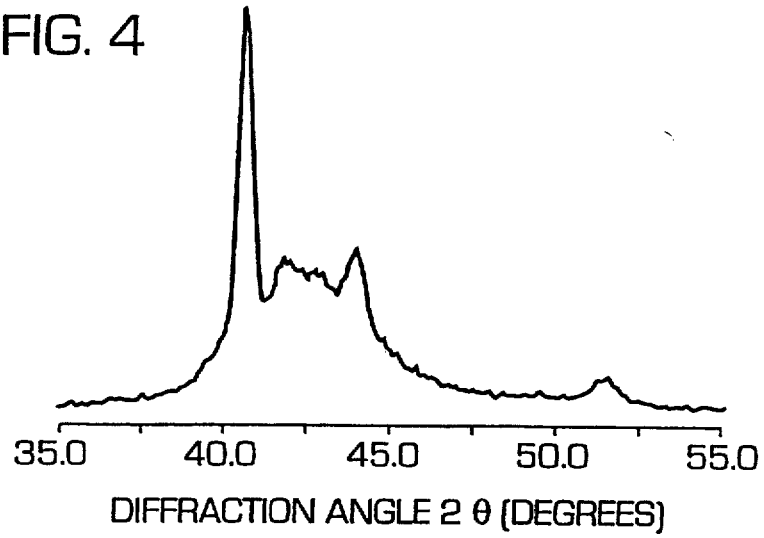
FIG. 4 shows the X-ray diffraction pattern of the alloy layer obtained in Comparative Example 4.

In Comparative Examples 3 and 4, the targets employed had a composition of 95% by weight nickel and 5% by weight molybdenum or 25% by weight nickel and 75% by weight molybdenum. The coating layers were formed in the same manner as in Example 11. The layer formation conditions are given in Table 5, and the properties of the coating layers are given in Table 6. In Comparative Example 3, the overvoltage was high since the contents of nickel and molybdenum were outside the claimed ranges. In Comparative Example 4, the overvoltage was high since the contents of nickel and molybdenum and the peak position were outside the claimed ranges. FIG. 4 shows the X-ray diffraction pattern of the coating layer obtained in Comparative Example 4.

EXAMPLE 15

A plating bath was prepared which contained 0.228 mol/l of nickel sulfate (hexahydrate) 0.012 mol/l of sodium molybdate (dihydrate) and 0.344 mol/l of trisodium citrate (dihydrate). The pH of the bath was adjusted to 8.0 by the addition of aqueous 28% ammonia. The electrode base material was a nickel disc plate (electrode area of 78.5 $mm^2$) which had been degreased with alcohol and etched by nitric acid. The counter electrode was a nickel plate.

The plating was conducted at a bath temperature controlled at 50° C. at a current density of 5 $A/dm^2$ for 24 minutes to prepare an electrode having a nickel-molybdenum alloy deposited on the electrode base material. As a result of measurement using an X-ray microanalyzer, the alloy layer was found to contain molybdenum at a concentration of 39.0% by weight. The main peak of the CuKα X-ray diffraction pattern of the alloy layer was at an angle of 43.7°, and the half width thereof was 5.3°.

The hydrogen overvoltage was measured with this electrode in a 32.5% sodium hydroxide solution at 90° C., and was found to be 108 mV at a current density of 40 $A/dm^2$.

EXAMPLES 16–22 AND COMPARATIVE EXAMPLES 5–13

These experiments were conducted in the same manner as Example 15 regarding the nickel source, the molybdenum source, the complexing agent, the electrode base material, the pretreatment of the electrode base material, the counter electrode, the measurement method of the molybdenum concentration in the alloy layer, the measurement method of the X-ray diffraction pattern and the hydrogen overvoltage measurement.

In Examples 16–17 and Comparative Examples 5–6, the alloy layers were prepared by changing the molar ratio Mo/(Ni+Mo) in the plating bath. Table 7 gives the molybdenum concentrations, the main peak positions and the peak half widths of the alloy layers obtained, and the hydrogen overvoltage of the resulting electrodes. In Table 7, the hydrogen overvoltage was higher in Comparative Examples 5 and 6 since the Mo/(Mo+Ni) molar ratio was outside the range of the present invention.

Similarly, in Examples 18–19 and Comparative Examples 7–8, coating layers were formed on the electrode base material by changing the total concentration of nickel and molybdenum in the plating bath. Table 8 gives the molybdenum concentrations, the main peak positions, the peak half widths and the hydrogen overvoltages of the resulting alloy layers.

In Examples 20–22 and Comparative Examples 9–10, coating layers were formed on the electrode base material by changing the pH of the plating bath. Table 9 gives the molybdenum concentrations, the main peak positions, the peak half widths and the hydrogen overvoltages of the resulting alloy layers. As shown in Table 8, the hydrogen overvoltage was higher in Comparative Examples 7 and 8 since the total concentrations of nickel and molybdenum were outside the range of the present invention and, as shown in Table 9, the hydrogen overvoltage was higher in Comparative Examples 9–10 since the pH of the plating bath was outside the range of the present invention.

Coating alloy layers were separately formed and heat treated in the air at 150° C. for one hour. Table 10 gives the positions and half widths of the main peaks and the crystal structures of the alloy layers identified by X-ray diffraction patterns the hydrogen overvoltages of the electrodes. Table 10 shows that the heat treatment at 150° C. narrowed the peak half width and gave rise to a new diffraction peak of an intermetallic compound of $Ni_4Mo$ and caused a rise in the overvoltage.

Figure 5:
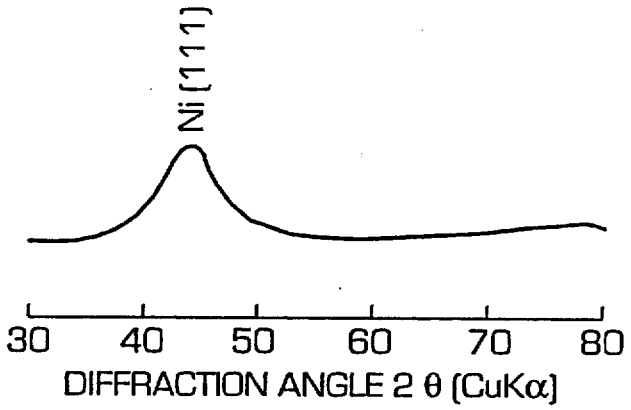
FIG. 5 shows the X-ray diffraction pattern of the alloy layer obtained in Example 13.
Figure 6:
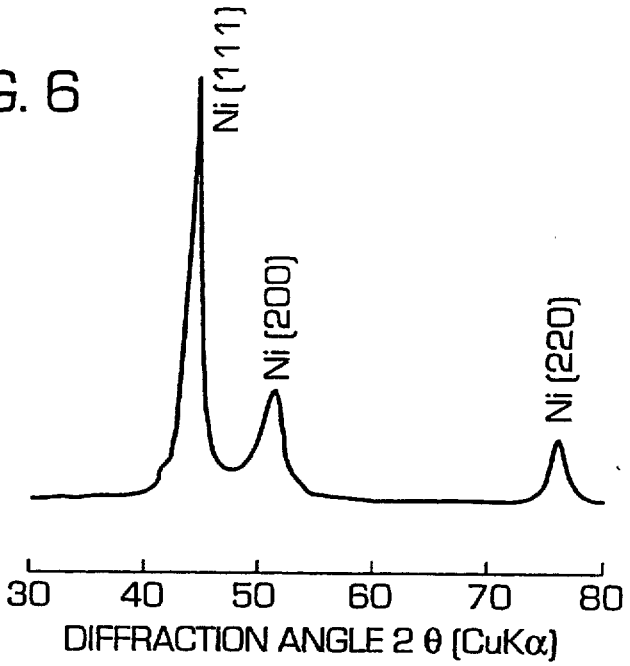
FIG. 6 shows the X-ray diffraction pattern of the alloy layer obtained in Comparative Example 5.
Figure 7:
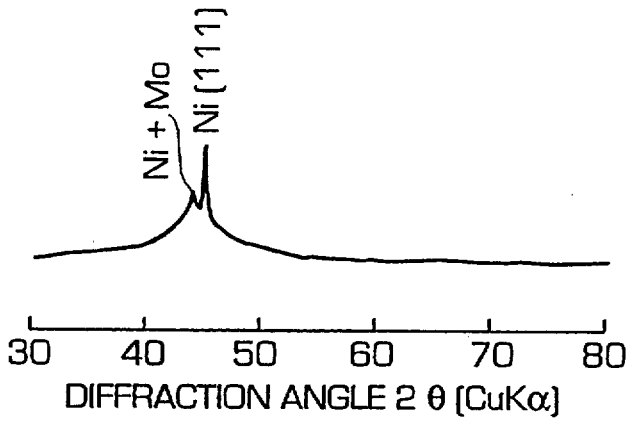
FIG. 7 shows the X-ray diffraction pattern of the alloy layer obtained in Comparative Example 11.

FIGS. 5, 6, and 7 show, respectively, the X-ray diffraction patterns of the alloy layer of Example 16, Comparative Example 5 and Comparative Example 11.

It has been shown that the active cathode produced according to the present invention exhibits an overvoltage as low as 110–150 mV in electrolysis at 90° C. and a current density of 40 $A/dm^2$ in a 32.5% sodium hydroxide solution, and has excellent cathode properties. Such cathode performance is achieved by an electrode comprising an electroconductive base material coated with an alloy layer containing at least nickel and molybdenum, the alloy layer being produced by controlling the production conditions so that the alloy layer contains molybdenum at a content ranging from 10 to 65% by weight, and shows only a peak in the X-ray diffraction pattern there of with a CuKα line at an angle ranging from 42 to 45° with a peak half width ranging from 0.4 to 7°.

The cathode of the present invention lowers electric power consumption in the electrolysis of an aqueous alkali metal chloride solution to contribute greatly to energy savings in the chlorine-alkali industries.

TABLE 1

| | Coating Layer Forming Conditions | | | | | |
|---|---|---|---|---|---|---|
| | Target composition (weight %) | | Base material potential | Reaction | Vacuum degree | Arc current |
| | Ni | Mo | (V) | gas | (Torr) | (A) |
| Example | | | | | | |
| 1 | 60 | 40 | −40 | Steam | $1 \times 10^{-3}$ | 100 |
| 2 | 60 | 40 | −40 | Nitrogen | $1 \times 10^{-3}$ | 100 |
| 3 | 60 | 40 | −40 | Oxygen | $1 \times 10^{-3}$ | 100 |
| 4 | 60 | 40 | −40 | Oxygen | $1 \times 10^{-3}$ | 100 |
| 5 | 60 | 40 | 0 | Oxygen | $1 \times 10^{-3}$ | 100 |
| 6 | 60 | 40 | 20 | Oxygen | $1 \times 10^{-3}$ | 100 |
| 7 | 60 | 40 | 40 | Oxygen | $1 \times 10^{-3}$ | 100 |
| Comparative Example | | | | | | |
| 1 | 60 | 40 | −300 | Steam | $1 \times 10^{-3}$ | 100 |
| 2 | 60 | 40 | −300 | Oxygen | $1 \times 10^{-3}$ | 100 |

TABLE 2

| | Coating Layer Forming Conditions | | | | |
|---|---|---|---|---|---|
| | Alloy composition (% by weight) | | Peak | Peak | Hydrogen overvoltage |
| | Ni | Mo | position | half-width | (mV) |
| Example | | | | | |
| 1 | 61.7 | 38.3 | 43.5° | 1.0° | 127 |
| 2 | 59.5 | 40.5 | 43.6° | 0.9° | 128 |
| 3 | 59.8 | 40.2 | 43.6° | 0.6° | 141 |
| 4 | 62.8 | 37.2 | 43.6° | 1.2° | 125 |
| 5 | 62.4 | 37.6 | 43.7° | 1.8° | 121 |
| 6 | 63.2 | 36.8 | 43.6° | 1.2° | 123 |
| 7 | 62.9 | 37.1 | 43.7° | 0.8° | 137 |
| Comparative Example | | | | | |
| 1 | 51.4 | 48.6 | 43.4° | 0.3° | 319 |
| 2 | 50.8 | 49.2 | 43.5° | 0.3° | 285 |

TABLE 3

| | Coating Layer Forming Conditions | | | | | | | |
|---|---|---|---|---|---|---|---|---|
| | Target composition (weight %) | | | | Base material potential | Re-action | Vacuum degree | Arc current |
| Example | Ni | Mo | Ag | La | (V) | gas | (Torr) | (A) |
| 8 | 60 | 40 | — | — | 0 | Oxygen | $3 \times 10^{-3}$ | 100 |
| 9 | 57 | 38 | 5 | — | 0 | Oxygen | $3 \times 10^{-3}$ | 100 |
| 10 | 57 | 38 | — | 5 | 0 | Oxygen | $3 \times 10^{-3}$ | 100 |

TABLE 4

| | Properties of Coating Layer | | | | | | |
|---|---|---|---|---|---|---|---|
| | Alloy composition (% by weight) | | | | Peak position | Reaction | Hydrogen overvoltage |
| Example | Ni | Mo | Ag | La | potential | half-width | (mV) |
| 8 | 61.5 | 38.5 | — | — | 43.8° | 1.8° | 103 |
| 9 | 60.2 | 36.4 | 3.4 | — | 43.7° | 2.2° | 82 |
| 10 | 58.4 | 37.7 | — | 3.9 | 43.8° | 2.8° | 88 |

TABLE 5

| | Coating Layer Forming Conditions | | | | | |
|---|---|---|---|---|---|---|
| | Target composition (weight %) | | Base material potential | Reaction | Vacuum degree | Arc current |
| | Ni | Mo | (V) | gas | (Torr) | (A) |
| Example | | | | | | |
| 11 | 87 | 13 | −40 | Oxygen | $1 \times 10^{-3}$ | 100 |
| 12 | 82 | 18 | −40 | Oxygen | $1 \times 10^{-3}$ | 100 |
| 13 | 43 | 57 | −40 | Oxygen | $1 \times 10^{-3}$ | 100 |
| 14 | 38 | 62 | −40 | Oxygen | $1 \times 10^{-3}$ | 100 |
| Comparative Example | | | | | | |
| 3 | 95 | 5 | −40 | Oxygen | $1 \times 10^{-3}$ | 100 |
| 4 | 25 | 75 | −40 | Oxygen | $1 \times 10^{-3}$ | 100 |

TABLE 6

| | Properties of Coating Layer | | | | |
|---|---|---|---|---|---|
| | Alloy composition (% by weight) | | Peak | Peak | Hydrogen overvoltage |
| | Ni | Mo | position | half-width | (mV) |
| Example | | | | | |
| 11 | 88.5 | 11.5 | 43.8° | 0.5° | 146 |
| 12 | 83.2 | 16.8 | 43.6° | 0.8° | 135 |
| 13 | 42.9 | 57.1 | 43.6° | 0.6° | 149 |
| 14 | 37.7 | 62.3 | 43.7° | 0.6° | 149 |
| Comparative Example | | | | | |
| 3 | 96.8 | 3.2 | 43.6° | 0.5° | 252 |
| 4 | 22.4 | 77.6 | 40.7° | 0.6° | 273 |

TABLE 7

Effects of Mo/(Ni + Mo) Ratio in Plating Bath

| | | Example | | | Comparative Example | |
|---|---|---|---|---|---|---|
| | | 15 | 16 | 17 | 5 | 6 |
| Plating bath composition | | | | | | |
| Ni ion | (mol/l) | 0.028 | 0.228 | 0.228 | 0.228 | 0.228 |
| Mo ion | (mol/l) | 0.012 | 0.0268 | 0.057 | 0.0012 | 0.114 |
| Citrate ion | (mol/l) | 0.344 | 0.344 | 0.344 | 0.344 | 0.344 |
| Mo/(Ni + Mo) | (mol %) | 5.0 | 10.5 | 20.0 | 0.5 | 33.3 |
| Ni + Mo concentration | (mol/l) | 0.24 | 0.26 | 0.29 | 0.23 | 0.34 |
| Plating conditions | | | | | | |
| Current density | ($A/dm^2$) | 5 | 5 | 5 | 5 | 5 |
| Temperature | (°C.) | 50 | 50 | 50 | 50 | 50 |
| Plating time | (min) | 24 | 24 | 24 | 24 | 24 |
| pH | | 8.0 | 8.0 | 8.0 | 8.0 | 8.0 |
| Mo concentration in alloy layer | (wt %) | 39.0 | 41.2 | 45.0 | 9.7 | 68.5 |
| X-ray diffraction main peak | | | | | | |
| Position | | 43.7° | 43.7° | 43.7° | 44.2° | 43.7° |
| Half width | | 5.3° | 6.0° | 6.0° | 1.0° | 5.7° |
| Hydrogen overvoltage | (mV) | 108 | 120 | 127 | 298 | 220 |

TABLE 8

Effects of (Ni + Mo) Total Concentration in Plating Bath

| | | Example | | Comparative Example | |
|---|---|---|---|---|---|
| | | 18 | 19 | 7 | 8 |
| Plating bath composition | | | | | |
| Ni ion | (mol/l) | 0.456 | 0.114 | 0.912 | 0.057 |
| Mo ion | (mol/l) | 0.038 | 0.0095 | 0.076 | 0.00475 |
| Citrate ion | (mol/l) | 0.688 | 0.172 | 1.380 | 0.138 |
| Mo/(Ni + Mo) | (mol %) | 7.7 | 7.7 | 7.7 | 7.7 |
| Ni + Mo concentration | (mol/l) | 0.50 | 0.12 | 0.99 | 0.06 |
| Plating conditions | | | | | |
| Current density | ($A/dm^2$) | 5 | 5 | 5 | 5 |
| Temperature | (°C.) | 50 | 50 | 50 | 50 |
| Plating time | (min) | 24 | 24 | 24 | 24 |
| pH | | 7.8 | 7.7 | 7.8 | 7.8 |
| Mo concentration in alloy layer | (wt %) | 37.5 | 45.3 | 34.7 | 66.5 |
| X-ray diffraction main peak | | | | | |
| Position | | 43.7° | 43.7° | 43.9° | 43.7° |
| Half-width | | 6.0° | 5.2° | 0.3° | 6.5° |
| Hydrogen overvoltage | (mV) | 130 | 121 | 288 | 257 |

TABLE 9

Effects of pH of Plating Bath

| | | Example | | | Comparative Example | |
|---|---|---|---|---|---|---|
| | | 20 | 21 | 22 | 9 | 10 |
| Plating bath composition | | | | | | |
| Ni ion | (mol/l) | 0.228 | 0.228 | 0.228 | 0.228 | 0.228 |
| Mo ion | (mol/l) | 0.019 | 0.019 | 0.019 | 0.019 | 0.019 |
| Citrate ion | (mol/l) | 0.344 | 0.344 | 0.344 | 0.344 | 0.344 |
| Mo/(Ni + Mo) | (mol %) | 7.7 | 7.7 | 7.7 | 7.7 | 7.7 |
| Ni + Mo concentration | (mol/l) | 0.25 | 0.25 | 0.25 | 0.25 | 0.25 |
| Plating conditions | | | | | | |
| Current density | ($A/dm^2$) | 5 | 5 | 5 | 5 | 5 |
| Temperature | (°C.) | 50 | 50 | 50 | 50 | 50 |

TABLE 9-continued

| Effects of pH of Plating Bath | | Example | | | Comparative Example | |
|---|---|---|---|---|---|---|
| | | 20 | 21 | 22 | 9 | 10 |
| Plating time | (min) | 24 | 24 | 24 | 24 | 24 |
| pH | | 7.0 | 8.5 | 9.0 | 10.5 | 5.0 |
| Mo concentration in alloy layer | (wt %) | 38.5 | 39.6 | 36.0 | 9.0 | 8.5 |
| X-ray diffraction main peak | | | | | | |
| Position | | 44.0° | 44.0° | 44.0° | 44.0° | 44.0° |
| Half-width | | 5.5° | 6.0° | 5.8° | 0.4° | 0.3° |
| Hydrogen overvoltage | (mV) | 107 | 111 | 109 | 197 | 238 |

TABLE 10

| Effects of Heat Treatment at 150° C. after Plating | | Comparative Example | | |
|---|---|---|---|---|
| | | 11 | 12 | 13 |
| Plating bath composition | | | | |
| Ni ion | (mol/l) | 0.228 | 0.228 | 0.228 |
| Mo ion | (mol/l) | 0.019 | 0.057 | 0.019 |
| Citrate ion | (mol/l) | 0.344 | 0.344 | 0.344 |
| Mo/(Ni + Mo) | (mol %) | 7.7 | 20.0 | 7.7 |
| Plating conditions | | | | |
| Current density | ($A/dm^2$) | 5 | 5 | 5 |
| Temperature | (°C.) | 50 | 50 | 50 |
| Plating time | (min) | 24 | 24 | 24 |
| pH | | 7.8 | 8.0 | 9.0 |
| Mo concentration in alloy layer | (wt %) | 40.2 | 45.0 | 36.5 |
| Heat treatment temperature after plating | (°C.) | 150 | 150 | 150 |
| X-ray diffraction main peak | | | | |
| Position | | 44.5° | 44.5° | 44.5° |
| Half-width | | 0.3° | 0.3° | 0.3° |
| Alloy layer crystal after heat treatment | | $Ni_4Mo$ | $Ni_4Mo$ | $Ni_4Mo$ |
| Hydrogen overvoltage | (mV) | 108 | 120 | 127 |

What is claimed is:

1. A low hydrogen overvoltage cathode comprising an electroconductive base material coated with an alloy layer containing nickel and molybdenum, the alloy layer containing the nickel at a content ranging from 35 to 90% by weight and the molybdenum at a content ranging from 10 to 65% by weight, and showing, in X-ray diffraction with CuKα line, only one main peak at an angle ranging from 42.0 to 45.0° with a peak half-width ranging from 0.4 to 7° wherein said one main peak corresponds to Ni(111).

2. The low hydrogen overvoltage cathode according to claim 1, wherein the alloy layer contains at least one of 4d transition metals, silver, and lanthanide elements at a content ranging from 0.1 to 10% by weight.

3. The low hydrogen overvoltage cathode according to claim 1 or 2, produced by plating an electroconductive base material by an arc discharge type ion plating method with a target containing nickel at a content ranging from 35 to 90% by weight and molybdenum at a content ranging from 10 to 65% by weight, or in addition to nickel and molybdenum at least one of 4d transition metals, silver, and lanthanide elements at a content ranging from 0.1 to 10% by weight at a potential of the electroconductive base material ranging from −100 to 50 V with introduction of a gas containing at least one of hydrogen, carbon, nitrogen, and oxygen as a reaction gas.

4. The low hydrogen overvoltage cathode according to claim 3, wherein the main peak is at an angle ranging from 42.0 to 44.6°.

5. The low hydrogen overvoltage cathode according to claim 3, wherein the target contains at least one of the 4d transition metals at a content ranging from 0.1 to 10% by weight.

6. The low hydrogen overvoltage cathode according to claim 3, wherein the target contains at least one of the lanthanide elements at a content ranging from 0.1 to 10% by weight.

7. The low hydrogen overvoltage cathode according to claim 2, wherein the alloy layer contains at least one of the 4d transition metals at a content ranging from 0.1 to 10% by weight.

8. The low hydrogen overvoltage cathode according to claim 2, wherein the alloy layer contains at least one of the lanthanide elements at a content ranging from 0.1 to 10% by weight.

9. The low hydrogen overvoltage cathode according to claim 1, wherein the main peak is at an angle ranging from 42.0 to 44.6°.

* * * * *

UNITED STATES PATENT AND TRADEMARK OFFICE

CERTIFICATE OF CORRECTION

PATENT NO.: 5,948,223

DATED: September 07, 1999

INVENTOR(S): HORIKOSHI, HIDEHARU, SUETSUGU, KAZUMASA, SAKAKI, TAKASHI, YOSHIMITSU, KANJI

It is certified that error(s) appears in the above-identified patent and that said Letters Patent is hereby corrected as shown below:

Column 4, line 35 delete "$C_2H_8$" and insert --$C_2H_6$--.

In the drawings, Figs. 1 and 2 should be deleted and replaced with Figs. 1-7 as per attached.

Signed and Sealed this

Twenty-second Day of August, 2000

*Attest:*

Q. TODD DICKINSON

*Attesting Officer*

*Director of Patents and Trademarks*